United States Patent [19]

Lonn et al.

[11] Patent Number: 4,893,875

[45] Date of Patent: Jan. 16, 1990

[54] GROUND ENGAGING BIT HAVING A HARDENED TIP

[75] Inventors: Alan H. Lonn, Edelstein; Gene R. Klett, Washington, both of Ill.

[73] Assignee: Caterpillar Inc., Peoria, Ill.

[21] Appl. No.: 285,564

[22] Filed: Dec. 16, 1988

[51] Int. Cl.[4] ..... E21C 35/18

[52] U.S. Cl. ..... 299/91; 299/86; 175/411; 172/745

[58] Field of Search ..... 299/79, 86, 91; 175/409–411, 374, 375; 76/101 E, 108 R, 108 A, DIG. 5, DIG. 11; 407/118; 172/713, 745; 51/309

[56] References Cited

U.S. PATENT DOCUMENTS

| | | | |
|---|---|---|---|
| 3,331,637 | 7/1967 | Krekeler | 299/92 |
| 3,336,081 | 8/1967 | Ericsson | 299/91 |
| 3,655,244 | 4/1972 | Swisher | 299/91 |
| 3,718,370 | 2/1973 | Caserta | 299/91 |
| 4,497,520 | 2/1985 | Ojamen | 299/86 |
| 4,725,099 | 2/1988 | Penkunas et al. | 299/86 |

FOREIGN PATENT DOCUMENTS

| | | | |
|---|---|---|---|
| 0122893 | 10/1984 | European Pat. Off. | 299/91 |
| 259620 | 3/1988 | European Pat. Off. . | |
| 0402655 | 4/1974 | U.S.S.R. | 299/91 |
| 435352 | 11/1974 | U.S.S.R. . | |
| 751991 | 7/1980 | U.S.S.R. . | |
| 0781341 | 11/1980 | U.S.S.R. | 299/91 |
| 2166178 | 4/1986 | United Kingdom | 299/79 |

OTHER PUBLICATIONS

Caterpillar Inc. Drawings No. 9W6776 entitled BIT AS.-Cutter (Asphalt).

*Primary Examiner*—Bruce M. Kisliuk
*Attorney, Agent, or Firm*—J. W. Burrows

[57] ABSTRACT

Ground engaging bits having hardned tips are beneficial when working extremely hard ground and/or planing asphalt or concreate. In these applications, the ground engaging bits rotate in their holders while performing the cutting action. Since the material needed to make a hardened tip is normally very expensive, it is beneficial to best utilize all, or at least most of, the hardened tip and to provide a hardened top that remains sharp during its effective life. The present ground engaging bit has a body with a convex non-linear forward end surface and a hardened tip with a corresponding concave non-linear rearward end surface to mate with the forward end surface of the body. The hardened tip has a continuous concave surface of revolution defined on its intermediate portion with a radius thereof being less than the diameter of its rearward flange portion. This arrangement uses less material to form the hardened tip and also provides a bonded surface that during the brazing operation allows the brazing material to freely flow evenly over the interface between the two surfaces. This arrangement provides an effective ground engaging bit that remains sharp during the life of the ground engaging bit while using less material to make the hardened tip.

7 Claims, 2 Drawing Sheets

GROUND ENGAGING BIT HAVING A HARDENED TIP

DESCRIPTION

1. Technical Field

This invention relates generally to a ground engaging bit, and more particularly to a hardened tip that is bonded to a body of the ground engaging bit.

2. Background Art

Ground engaging bits normally include a body and a hardened tip secured to one end of the body. The hardened tip is made up of many different shapes, sizes and styles. Some of the ground engaging bits are designed to rotate within their holder, while others are designed to be held and prohibited from rotation. The ones that are designed to rotate normally have a hardened tip that is cylindrical in shape and bonded to the body of the bit by brazing. Since the hardened tip is the portion that directly engages the surface to be worked, the shape of the hardened tip is important in order to ensure that the hardened tip remains in a condition that allows adequate penetration of the surface that is being worked. Furthermore, since the hardened material is normally a more costly item, it is beneficial to use only the amount of hardened material necessary to accomplish the desired result and to obtain the most beneficial life of the hardened tip, while still maintaining the ability to penetrate the surface being worked.

Since in most cases the hardened tip is bonded to the body of the tip by brazing, it is necessary to provide a surface on both the hardened tip and the body to ensure a very strong bond between the hardened tip and the body. During the bonding of the hardened tip to the body, it is necessary to allow the brazing material to flow between the interface of the hardened tip of the body and not to trap the flux or any other impurities during the brazing process. Any entrapment of flux material or other impurities weakens the bond between the hardened tip and the body and can result in the hardened tip breaking loose from the body of the bit prematurely. If the hardened tip breaks free from the body of the bit, the body will wear extremely fast and the holder of the body will also become damaged, thus adding to the expense of replacing all of the needed components.

Two known ground engaging bits are shown in U.S. Pat. No. 4,497,520 to Randall W. Ojanen issued Feb. 5, 1985, and U.S. Pat. No. 4,725,099 to Joe Penkunas et al. issued Feb. 16, 1988. Each of these patents show a hardened tip secured to the body of a bit. However, each of these arrangements would potentially have the problem of trapping flux and/or other impurities during the brazing process since the bottom of the hardened tip is setting in a recess of the body. Furthermore, once the hardened tip is worn down to a point near the body of the bit, the bit is no longer sufficiently sharp and must be replaced. Consequently, a good percentage of the hardened tip still remains in the body and is cast aside unnecessarily.

U.S. Pat. No. 3,331,637 to C. B. Krekeler issued May 7, 1965, illustrates, in FIG. 9, an arrangement in which the hardened tip has a cavity and the body portion has a corresponding extension in which the hardened tip is bonded to the body by brazing. Even though this arrangement tends to more effectively utilize the hardened material, it still has the difficulty of potentially trapping flux and/or other impurities in the corners during the brazing operation.

Another example of a typical bit having a hardened tip is shown in Russian Patent No. 751991 which issued on July 30, 1980. In this arrangement, the hardened tip has a cavity that mates with an extension on the body of the bit and would be reasonably effective to better utilize the hardened material of the bit. However, due to the corners created by the cavity and the mating with the extension on the body, flux material and/or other impurities may be trapped at the various corners and/or intersections which results in an inferior bonded surface. Consequently, the hardened tip could prematurely break free from the body portion and result in additional damage to the body and/or holder.

As previously indicated, if the hardened tip becomes too blunt or dull, the tool becomes ineffective and must be replaced. Furthermore, if the interface between the hardened tip and the body of the bit is not sufficiently bonded, the hardened tip may prematurely break loose from the body. With the hardened tip no longer in place, the body will quickly wear, and possibly wear far enough to damage the holder, which adds tremendous cost to replacement of all the necessary components.

The present invention is directed to overcoming one or more of the problems as set forth above.

DISCLOSURE OF THE INVENTION

In one aspect of the present invention, a ground engaging bit is provided which includes a body and a hardened tip bonded thereto. The body of the bit has a generally convex non-linear forward end surface and the hardened tip has a generally concave non-linear rearward end surface that mates with the convex non-linear forward end surface of the body. The rearward end surface of the tip is bonded to the forward end surface of the body.

The present invention provides a ground engaging bit that has a non-linear interface between the hardened tip and the body of the bit which allows for free flow of the bonding material during the bonding operation. By providing the non-linear surface between the hardened tip and the body of the bit, there are no pockets or cavities to trap fluxing materials or any other impurities during the bonding operation. Therefore, an extremely strong bond is provided between the hardened tip and the body. Consequently, the hardened tip is securely bonded to the body and does not prematurely break loose during the normal life of the ground engaging bit.

BEST MODE FOR CARRYING OUT THE INVENTION

Figure 1:
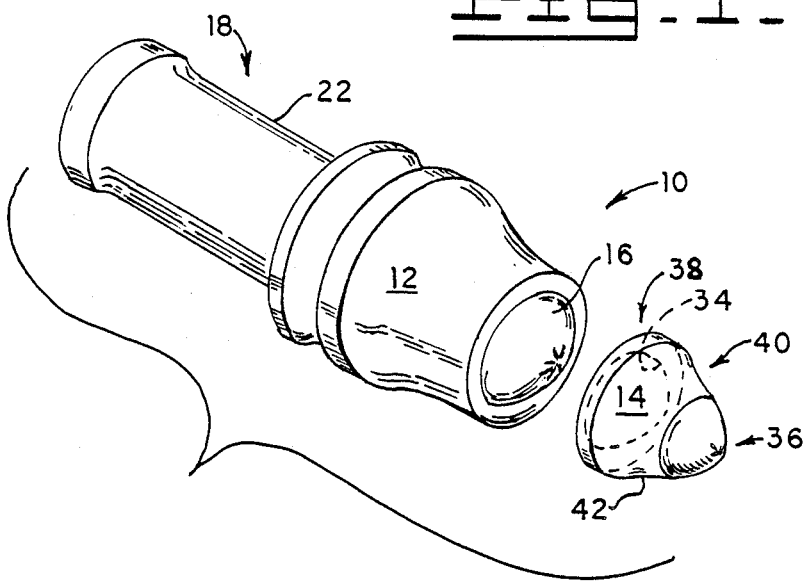
FIG. 1 is an isometric drawing incorporating an embodiment of the present invention.
Figure 2:
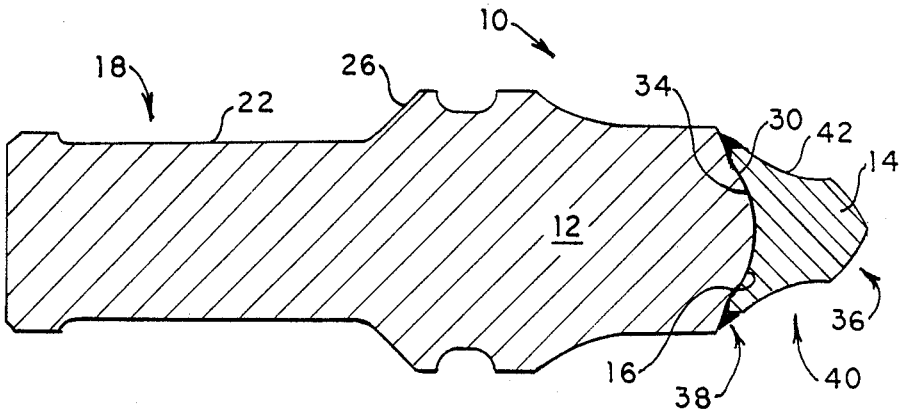
FIG. 2 is a drawing showing the parts bonded together and sectioned to further show the shape of the interface between the components.
Figure 3:
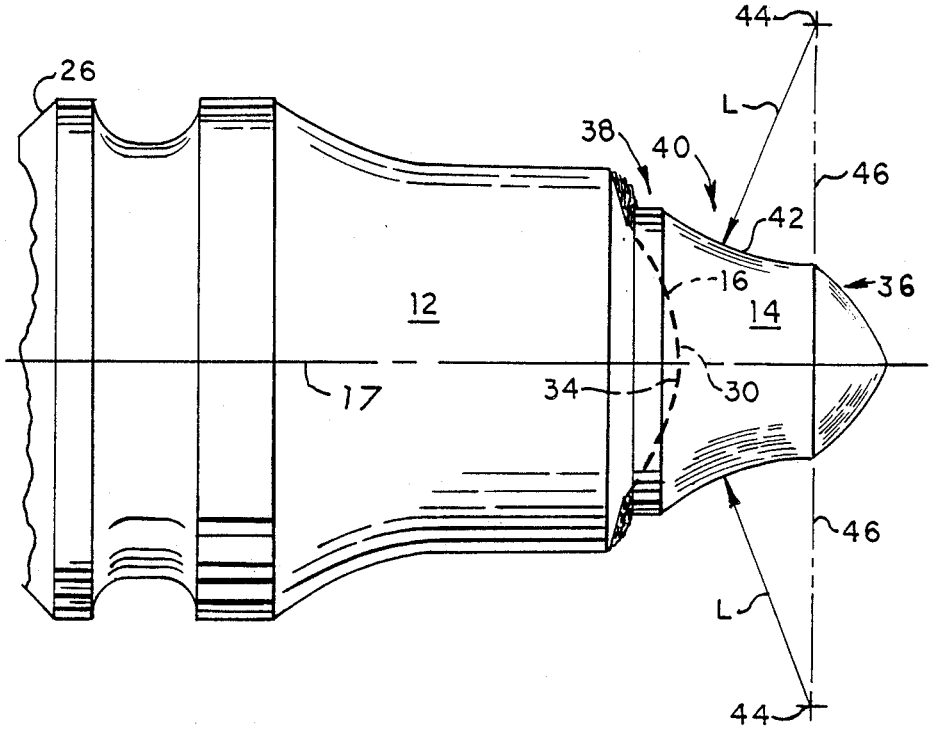
FIG. 3 is an enlarged drawing showing a portion of a ground engaging bit in elevation to better illustrate the shape of the hardened tip.

Referring now to the drawings, and more particular to FIGS. 1, 2 and 3, a ground engaging bit 10 is shown.

The ground engaging bit 10 includes a body 12 and a hardened tip 14.

Figure 4:
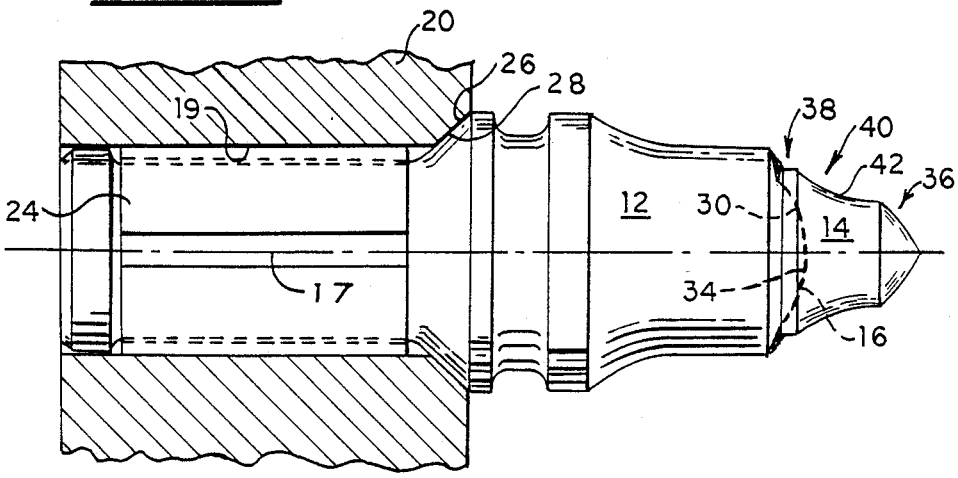
FIG. 4 is a drawing illustrating the ground engaging bit above and further shows the ground engaging bit assembled with a spring retainer and holding block.

The body 12 includes a convex non-linear forward end surface 16. The convex non-linear end surface 16 is generated by rotating a curved surface about an axis 17 of the ground engaging bit 10. Even though the forward end surface 16 is shown as being spherical in shape, it is well recognized that other non-linear shapes having no discontinuities could be utilized without departing from the essence of the invention. The body 12 includes a shank portion 18 operative to locate the bit in a holding block 20 as best illustrated in FIG. 4. A groove 22 is defined in the shank portion 18 and is adapted to receive a spring retainer 24 as illustrated in FIG. 4. The body 12 has a shoulder 26 thereon immediately adjacent the shank portion 18 and operative to abut a mating surface 28 of the holding block 20.

As specifically shown on FIGS. 2, 3 and 4, the hardened tip 14 is bonded to the body 12 by brazing. The braze material 30 between the hardened tip 14 and the body 12 is best illustrated in FIG. 2.

The hardened tip 14 has a concave non-linear rearward end surface 34 that is illustrated as being generally spherical in shape. The concave non-linear rearward end surface 34 is generated by rotating a curved line about the axis 17 and is adapted to mate with the convex non-linear surface 16 of the body 12. The hardened tip 14 further includes a conical end portion 36, a cylindrical rearward flange portion 38, and a middle portion 40. The middle portion 40 has a continuous concave surface of revolution 42 defined by rotating a double-curved surface about an axis. The concave surface of revolution 42 is disposed between and merging at the opposite ends with the forward conical end portion 36 and the rearward flange portion 38. It should be recognized that the conical end portion 36 could be of other shapes, such as spherical or pyramid shape, without departing from the essence of the invention.

As best shown in FIG. 3, the continuous concave surface of revolution 42 defines a center of radius 44. The center of radius 44 is located substantially on a plane 46 which passes through the intersection of the conical end portion 38 and the middle portion 40. The radius has a length "L" that is approximately twenty to thirty-five percent less than the diameter of the rearward flange portion 38.

INDUSTRIAL APPLICABILITY

In operation, the ground engaging bit 10 remains sharper during the life of the hardened tip and more efficiently utilizes most all of the hardened tip 14 before the ground engaging bit 10 is totally worn out. Consequently, only a very small percentage of the hardened tip 14, if any, is discarded when the useful life of the ground engaging bit 10 is over. The hardened tip 14 remains sharp since the center of radius 44 is located on the plane 46 and the length "L" of the radius is 20–35% less than the diameter of the rearward flange portion 38. This relationship allows the hardened tip to wear and yet not become extremely blunt during the useful life of the bit 10 or until the wear of the hardened tip 14 has substantially reached the body 12. By utilizing a smaller radius on the continuous concave surface of revolution 42, lesser amounts of the material necessary to make the hardened tip is needed, consequently reducing the total cost of the ground engaging bit 10.

Since, during operation, the ground engaging bit 10 is rotating, the hardened tip 14 will continually wear and normally maintains a conical end surface as the tip is wearing. Consequently, once the hard material has worn down close to the body 12, there is very little, if any, of the hardened tip 14 remaining on the body 12. This conservation of the materials necessary to make the hardened tip 14 is accomplished by utilizing the concave non-linear rearward end surface 34 of the hardened tip 14 which mates with the convex non-linear forward end surface 16 of the body 12. The concave non-linear rearward end surface 34 of the hardened tip 14 eliminates the additional material that is not being used during the normal life of the ground engaging bit 10.

Additionally, the interface between the concave non-linear rearward end surface 34 of the hardened tip 14 and the convex non-linear forward end surface 16 of the body 12 provides an ideal relationship for brazing the hardened tip 14 to the body 12. This interface provides a continuously curved surface which is free of discontinuities. By eliminating any and all discontinuities, such as, sharp corners, the brazing material is more free to flow along the surfaces of the interface and flush any fluxing material and/or other impurities away from the interface and out to the perimeter of the interface. Consequently, the brazed joint is substantially perfect and provides an extremely strong bond that prohibits the hardened tip 14 from prematurely breaking free from the body 12.

The unique interface between the hardened tip 14 and the body 12 provides a ground engaging bit 10 that best utilizes the expensive material of the hardened tip 14, consequently reducing the cost of the ground engaging bit 10. Furthermore, the relationship of the continuously curved concave surface of revolution 42 aids the hardened tip 14 in remaining sharp while also providing a shape that again best utilizes the expensive material that is used in making the hardened tip 14. By having the center of radius 44 on the plane 46, a smooth transition is provided from the conical end portion 36 to the cylindrical rearward flange portion 38. This smooth transition coupled with the desired length "L" of the radius helps to keep the hardened tip 14 sharp during its total useful life while also helping to conserve the quantity of materials needed to make the hardened tip 14.

Other aspects, objects and advantages of this invention can be obtained from a study of the drawings, the disclosure and the appended claims.

We claim:

1. A ground engaging bit, comprising:

a body having a generally convex non-linear forward end surface; and a hardened tip having a generally concave non-linear rearward end surface mating with the generally convex non-linear forward end surface of the body, said rearward end surface of the hardened tip being bonded to the forward end surface of the body and the hardened tip also having a substantially conical forward end portion, a cylindrical rearward flange portion, and a middle portion having a continuous concave surface of revolution disposed between and merging at its opposite ends with the forward end portion and the rearward flange portion, said continuous concave surface of revolution defining a radius having a center of radius located substantially on a plane which passes through the intersection of the conical forward end portion and the middle portion and the radius has a length (L)

approximately twenty to thirty five percent less than the diameter of the rearward flange portion.

2. The ground engaging bit as set forth in claim 1, wherein the hardened tip is bonded to the forward end surface of the body by a brazing material.

3. The ground engaging bit as set forth in claim 2, wherein the brazing material substantially covers the total surface between the rearward end surface of the hardened tip and the forward end surface of the body to provide a substantially defect free bond therebetween.

4. The ground engaging bit as set forth in claim 2, wherein the generally convex non-linear forward end surface of the body and the rearward end surface of the hardened tip are spherical in shape.

5. A hardened tip adapted for use in a ground engaging tip, comprising:

a substantially conical forward end portion, a cylindrical rearward flange portion, and a middle portion having a continuous concave surface of revolution disposed between and merging at its opposite ends with the forward end portion and the rearward flange portion, said, continuous concave surface of revolution defining a radius having a center of radius located substantially on a plane which passes through the intersection of the conical forward end portion and the middle portion and the radius has a length (L) approximately twenty to thirty five percent less than the diameter of the rearward flange portion.

6. The hardened tip as set forth in claim 5, wherein the cylindrical rearward flange portion has a generally concave non-linear rearward end surface defined therein.

7. The hardened tip as set forth in claim 5, wherein the generally concave non-linear rearward end surface is generally spherical in shape.

* * * * *